United States Patent [19]

Gross

[11] 4,215,242

[45] Jul. 29, 1980

[54] REVERBERATION SYSTEM

[75] Inventor: Glenn M. Gross, Chicago, Ill.

[73] Assignee: Norlin Industries, Inc., Lincolnwood, Ill.

[21] Appl. No.: 967,265

[22] Filed: Dec. 7, 1978

[51] Int. Cl.[2] ..... G10H 1/04

[52] U.S. Cl. ..... 179/1 J

[58] Field of Search ..... 179/1 J, 1 GS; 84/DIG. 26, 1.24

[56] References Cited

U.S. PATENT DOCUMENTS

| | | | |
|---|---|---|---|
| 1,947,621 | 2/1934 | Schreiber | 84/DIG. 26 |
| 3,955,193 | 5/1976 | Koffler et al. | 364/724 |
| 4,080,861 | 3/1978 | Wholahan | 179/1 F |
| 4,087,629 | 5/1978 | Atoji et al. | 179/1 J |

FOREIGN PATENT DOCUMENTS

| | | | |
|---|---|---|---|
| 796837 | 10/1968 | Canada | 179/1 J |

*Primary Examiner*—Malcolm A. Morrison
*Assistant Examiner*—E. S. Kemeny
*Attorney, Agent, or Firm*—Jack Kail; Ronald J. Kransdorf

[57] ABSTRACT

A reverberation sound producing apparatus includes a nonuniformly tapped delay line, a summing circuit applying an audio signal to the input of the tapped delay line and a feedback path coupling the output taps of the delay line back to its input through the summing circuit. A separate output path couples the reverberation signal from the feedback path to an output amplifier and speaker system. The feedback path is adjusted for minimizing loop gain and the effect of ripple in the frequency response of the delay line while the output path is adjusted for providing a smoothly decaying reverberation signal.

25 Claims, 6 Drawing Figures

REVERBERATION SYSTEM

BACKGROUND OF THE INVENTION

The present invention relates generally to sound reproduction systems and more particularly to an electronic reverberation sound producing apparatus useful in association with an electronic organ or the like.

Reverberation is a term commonly used to describe the effect of sound produced in a large auditorium which is brought about or caused by multiple reflections of the original sound waves against the walls of the hall with consequent audible repetitions of the sound at each reflection. The total effect caused by the reverberatory reflections is an apparent slow decay of the sound after each note has ended, rather than the abrupt, cold harshness otherwise characterizing non-reverberatory sounds.

An artificial reverberation system must, in general, provide a facility for continuously repeating each generated sound at relatively short repetition intervals, each repetition being somewhat lower in volume or amplitude than the last, until finally nothing more can be heard. The time interval between repetitions should be short enough so that the discrete repetitions blend together to form an apparently continuous gradually decaying sound. In addition, the repetitions should be spaced irregularly to simulate the complex reflections set up in a real environment. The reverberatory system should also affect the tones and harmonics of all frequencies, but not evenly. Thus, tones around the middle of the spectrum naturally have longer reverberation times (the time required for a tone to decay by 60 db) than bass and high treble tones. And, finally, the rate of decay of any tone should be approximately linear in terms of decibels or, stated otherwise, exponential in terms of amplitude.

Various systems are known in the prior art which attempt to satisfy these criteria. In one common system, an electromechanical device includes three springs each supported between an input and an output transducer. Standing waves created in the springs are translated into an audio signal by the output transducers and coupled to a suitable output system including one or more speakers. Such devices tend to be large in size and susceptible to mechanical shock and acoustic vibration. Moreover, the devices are normally quite frequency limited and their own inherent resonances tend to color the sound unnaturally.

Ultrasonic reverberation systems with increased bandwidth responses have been introduced in an attempt to improve upon the spring systems. In an ultrasonic reverberator, the audio signal is used to modulate an ultrasonic oscillator normally operating at a carrier frequency of about 20 KHz. The modulated ultrasonic signal is passed through a spring which sets up standing waves, the standing waves being demodulated by a receiving transducer and coupled as audio repetitions to the systems output. The use of the ultrasonic carrier signal reduces the ratio between the upper and lower frequencies at which the system must operate and thereby provides a somewhat improved audio response.

Other known reverberation systems include tape units wherein a continuous loop of recording tape is passed over, in turn, a record head, a plurality of playback heads and an erase head. The audio is recorded on the tape by means of the record head and the output is taken from the playback heads. An audio output signal may thus be formed comprising the original unmodified audio signal together with a plurality of slightly delayed replicas depending upon the spacing of the playback heads and the speed at which the tape is operated.

Relatively recently, various electronic reverberation systems have been proposed by the industry. These systems normally utilize multiple delay elements connected in feedforward or feedback relationship for repetitively recycling an input signal to develop a number of delayed and attenuated replicas, frequently referred to as echoes, of the original input signal. Ideally, this echo train, which is derived directly from the feedback or feedforward circuit, would be non-periodic in nature, exhibit a relatively high echo density and be characterized by a decay time to a −60 db level of about two seconds. The echo train thusly produced is combined with the original input signal to produce an overall reverberatory effect.

A critical parameter characterizing electronic reverberation system design is the loop gain exhibited by the circuit. As the loop gain approaches 0 db (i.e. unity) the circuit becomes highly unstable and relatively noisy. Loop gains, on the other hand, of about −3 db or less generally result in adequate system performance. Heretofore, the attainment of a low loop gain to insure system stability has been considered to be in conflict with the decay time parameter necessitating the acceptance of trade-offs between the two. More specifically, in order to produce a monotonically decaying reverberation signal using prior art circuits it has been necessary to emphasize the echo signals appearing at the outputs of the delay elements having the shortest associated delay times relative to those having longer delay times. Moreover, in order to achieve an adequate decay time, e.g. two seconds, it is necessary to minimize the attenuation levels while, at the same time, in order to achieve adequate circuit stability the attenuation levels must be maximized. While various attempts have been made to eliminate or reduce the effect of this patent conflict, none have proven altogether satisfactory.

Other deficiencies characterizing prior art electronic reverberation systems include their inability to properly simulate the frequency spectrum of a signal produced in a natural reverberatory environment. In particular, in a natural reverberatory environment, the higher and lower frequency components of the reverberation signal normally decay more rapidly with time so that only the mid-range frequency sounds remain. It will be appreciated that simply filtering the output of a reverberation system will not produce this gradual fading effect.

The production of multiphonic reverberation from a monophonic source is another feature not satisfactorily provided by prior art electronic reverberation systems. Multiphonic reverberation results in the development of a plurality of output reverberation signals each applied to a separate output system such that the sound will appear to come from a plurality of different directions similar to the effect produced by reflections of sound in a large room under natural reverberation conditions.

SUMMARY OF THE INVENTION

It is therefore a general object of the invention to provide a new and improved reverberation sound producing apparatus.

More specifically, it is an object of the invention to provide a reverberation sound producing apparatus which is highly stable in operation, characterized by a high density, non-periodic echo pattern, exhibits minimal ripple effects and provides a smoothly decaying output signal.

Another object of the invention includes providing a reverberation sound producing apparatus generating multiphonic reverberatory signals from a monophonic signal source.

These and other objects are achieved in a system including a tapped delay line having an input connected through a first summer to a source of audio signals. Selected output taps of the delay line are connected by parallel networks to the inputs of a second summer whose output is fed back to an input of the first summer. The selected output taps are coupled by a separate series of parallel networks to an output terminal for application to a speaker system or the like. In a second embodiment, each of the selected output taps is coupled to a plurality of output terminals for application to a corresponding set of speaker systems such that a multiphonic reverberatory effect is produced from the monophonic signal source. Separating the feedback networks from the output networks allows for adjustments minimizing feedback loop gain and frequency response ripple while maintaining a smoothly decaying reverberation signal.

BRIEF DESCRIPTION OF THE DRAWINGS

FIGS. 4A and 4B graphically represent signals developed at the taps of the delay line of FIG. 1 and the effect of attenuators 61–63 thereon.

DESCRIPTION OF THE PREFERRED EMBODIMENT

Figure 1:
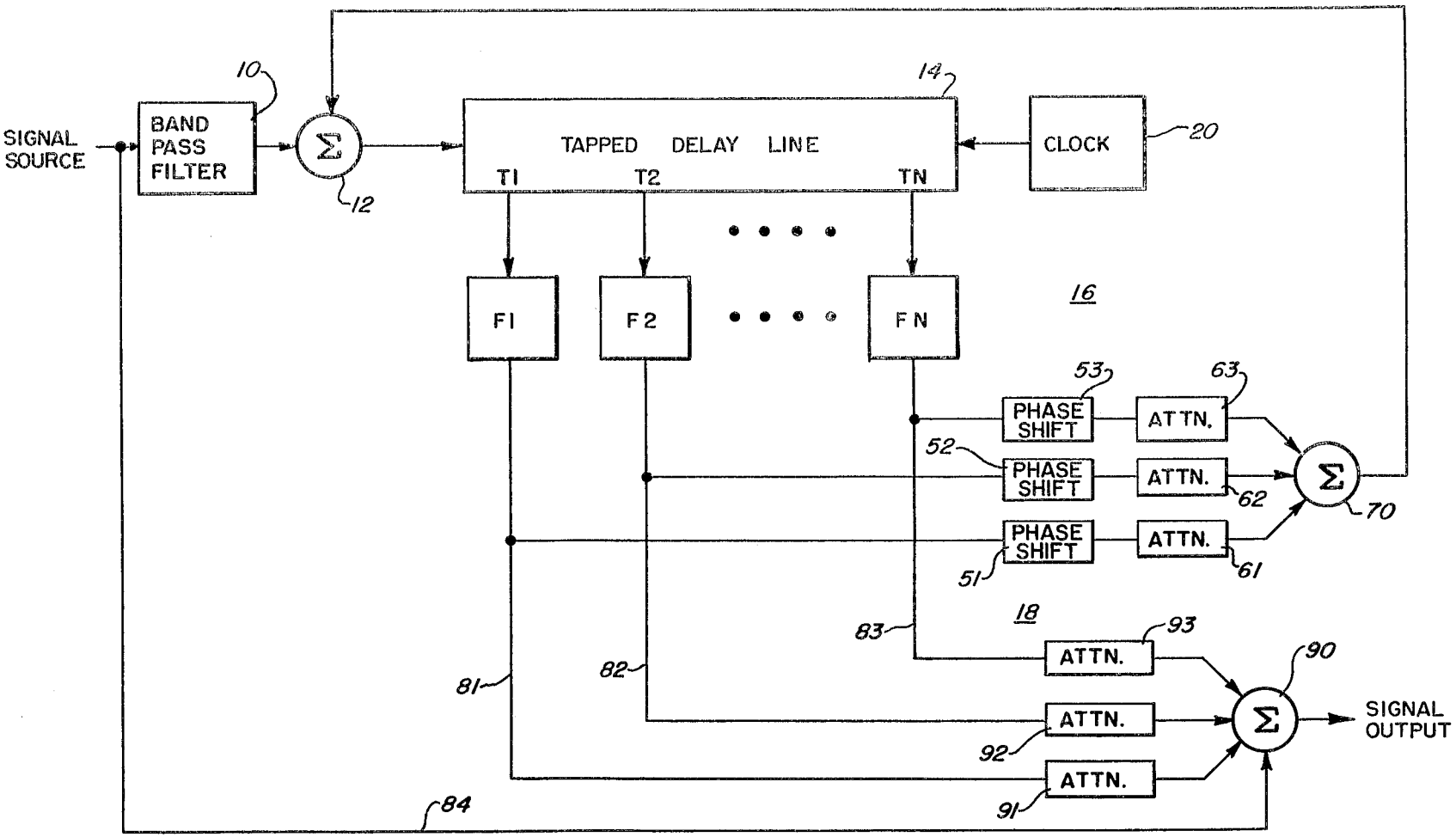
FIG. 1 is a functional block diagram illustrating a preferred embodiment of the reverberation sound producing apparatus of the invention.

Referring to FIG. 1, the reverberation system of the invention basically comprises an input bandpass filter 10, a summer 12, a tapped delay line 14, a feedback path 16 and a separate output path 18. In general terms, an input signal supplied to bandpass filter 10 is cycled through tapped delay line 14 and feedback path 16, which is adjusted for relatively low gain and therefore high stability, a number of times producing an echo train decaying to a −60 db level in about two seconds. The echo train developed by feedback path 16 is coupled to output path 18 and combined with the original input signal to produce an output reverberation signal. Significantly, the separation of feedback path 16 from output path 18 enables the use of a feedback path adjusted for exhibiting low gain and minimum ripple without adversely affecting the output reverberation signal.

Referring to FIG. 1 in further detail, an input audio signal is coupled from an audio signal source to the input of bandpass filter 10. Bandpass filter 10 includes a high pass section and a low pass section to appropriately band limit the input audio signal to a mid-range frequency band as normally exists in the case of natural reverberation. The output of bandpass filter 10 is then coupled to a first input of summer 12 whose output, in turn, is applied to the input of tapped delay line 14. Delay line 14 preferably comprises an analog charge transfer device such as a bucket brigade delay line or a charge coupled delay line configured for delaying the signal supplied to its input by a fixed amount determined by the length of the line and the frequency of its associated driver clock 20. Alternately, digital delays or tape delays could be used in lieu of the illustrated charge transfer device.

The signal applied to the input of delay line 14 appears sequentially at each of the delay line taps T1, T2 . . . TN whose number has been left intentionally general to emphasize the fact that different implementations of the invention may utilize different numbers of delay line taps. In any event, the time delayed signals appearing on taps T1, T2 . . . TN are coupled by feedback path 16 to the second input of summer 12 where they form, together with the bandpass filtered input signal, the input applied to delay line 14.

Figure 2:
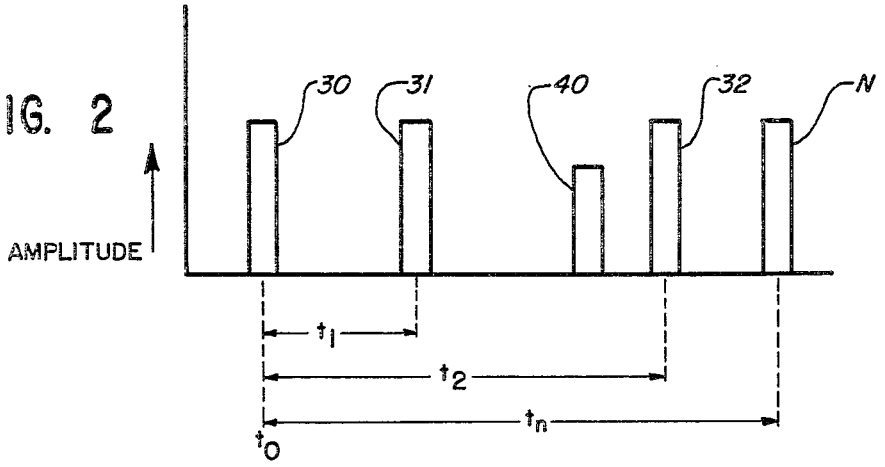
FIG. 2 is a graphical representation of the signals produced at the taps of the delay line shown in FIG. 1.

The foregoing may be more readily understood with reference to the graph of FIG. 2. In FIG. 2, assume that the original input signal from the signal source applied through filter 10 and summer 12 to the input of delay line 14 is represented by a pulse 30 occurring at a time $t_o$. Pulse 30 will sequentially appear at taps T1, T2 . . . TN as pulses 31, 32 . . . N, which pulses are time delayed with respect to pulse 30 by intervals equivalent to the associated tap delays $t_1, t_2, \ldots t_n$. A pulse 40 attributable to the recycling of pulse 31 through the delay line may appear at tap T1 and be interleaved between pulses 31 and 32. Furthermore, time delayed replicas of recycled pulse 31 would also appear at the remaining taps T2 . . . TN. Of course, the remaining pulses 32 . . . N will be similarly recycled through delay line 14 causing further interleaving of pulses within the echo train. Moreover, the recycled pulses will themselves again be recycled through the delay line a number of times until attenuated to a non-audible level. In this manner, a complex and irregular train of echoes is produced at the taps which is highly non-periodic in nature thus properly simulating the effects of a natural reverberatory environment.

It will be appreciated that the pulse density characterizing the echo train is also a function of tap spacing, i.e. the tap delay times $t_1, t_2 \ldots t_n$. In general, as tap spacing is decreased the echo density increases proportionately. A desired density may thus be realized by providing an appropriate number of taps T1, T2 . . . TN suitably spaced in relation to each other. Another factor influencing the selection of tap spacing is that pulse overlap causing signal reinforcement and poor frequency response is an undesirable condition. With further reference to FIG. 2, consider the situation where delay times $t_1$ and $t_2$ are selected such that $t_2=2t_1$. Under these conditions, the pulse echoes 32 and 40 will overlap in time such that the output reverberation signal will be unduly reinforced during this interval. It has been found that such overlap can be eliminated by selecting taps having tap delay times which are not integer multiples of each other and which have no low common denominator. In an implementation of the invention a delay line was utilized five taps with associated delay times of 35 ms., 93 ms., 176 ms., 284 ms., and 382 ms. This selection of tap spacing produced adequate echo density, low periodicity in the output reverberation signal and substantially no echo reinforcement.

Figure 3:
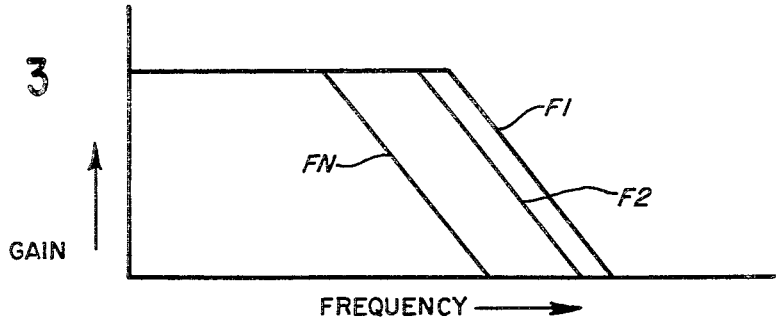
FIG. 3 illustrates the frequency response characteristics of the filters shown in FIG. 1.

Feedback path 16 includes a filter bank comprising a plurality of low pass filters F1 through FN each having an input connected to a respective tap T1 through TN of delay line 14. Each of the filters F1 through FN is tuned monotonically lower than the previous filter in the bank as illustrated in FIG. 3. Thus, filter F1 is characterized by the highest cut-off frequency, filter F2 has a somewhat reduced cut-off frequency and so on until the last filter FN which exhibits the lowest cut-off frequency. As thusly configured, the filter bank simulates the effect present in natural reverberatory environments where the walls, etc. of the room or auditorium gradually remove the high frequency components of the sound which is produced. In particular, as an input signal progresses down delay line 14 the resulting echoes produced at taps T1 through TN will be gradually reduced in high frequency content. Thus, referring again to FIG. 2, echo or pulse 31 would have the highest frequency content, echo 32 a somewhat reduced level of high frequency content and so on. The overall effect is that the echo train established in feedback path 16 comprises a plurality of time related signals whose high frequency content gradually fades to a selected minimum level leaving primarily low and mid-range frequency components.

The output of each filter F1 through FN is coupled to the input of a respective phase selector 51, 52 and 53. The outputs of phase selectors 51, 52 and 53 are in turn coupled through a series of variable attenuators 61, 62 and 63 to the inputs of a summer 70 whose output is fed back to the second input of summer 12. The gain characterizing feedback path 16 is determined largely by the settings of variable attenuators 61, 62 and 63. As mentioned previously, for purposes of operational stability, it is desirable to maintain the loop gain at a minimum level.

Output path 18 comprises a series of lines 81, 82 and 83 connecting the outputs of filters F1 through FN to the inputs of a third summer 90 through a set of variable attenuators 91, 92 and 93. In addition, the audio input signal is coupled from the signal source over a line 84 to the final input of summer 90. Summer 90 thus combines the reverberation signal developed at the outputs of filters F1 through FN with the original audio input signal to develop an output signal which may be applied to an output amplifier and speaker system.

It has been found that the loop gain of feedback path 16 may be most advantageously minimized while simultaneously providing an adequate decay time by setting attenuators 61, 62 and 63 for emphasizing the signals developed at the most remote tap TN relative to the signals developed at the closer in taps. Thus, in relative terms, the attenuation characterizing attenuator 63 is set at a relatively low level compared to the settings of attenuators 61 and 62. However, while low in relative terms, the absolute value of the attenuation characterizing attenuator 63 is rather high in order to insure minimum loop gain. And, although the decay envelope of the resulting signal produced in feedback path 16 is distorted, such as compensated for by the operation of output path 18.

Figure 4A:
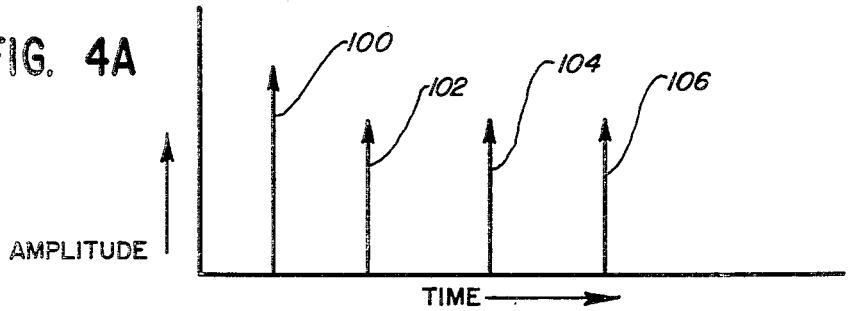
Figure 4A:
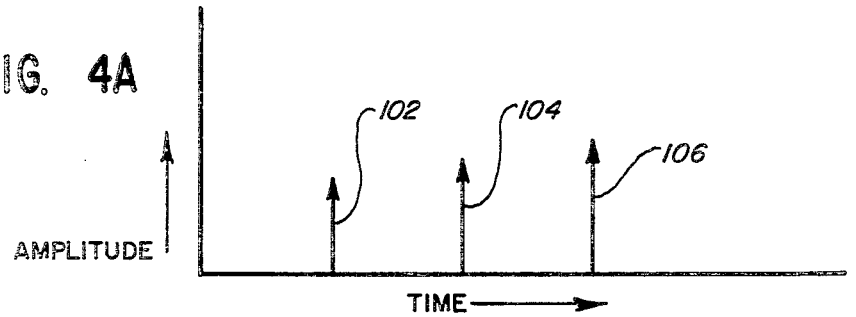

FIGS. 4A and 4B illustrate the effect achieved by the invention. In FIG. 4A, a pulse 100 is intended to represent an input signal to delay line 14 and pulses 102, 104 and 106 the resulting echoes produced at taps T1, T2 and TN before being processed through feedback path 16. Further assume that a −60 db decay time or reverberation time of two seconds is desired and that the delay times $t_1$, $t_2$ and $t_n$ associated with taps T1, T2 and TN are 50, 100 and 200 milliseconds respectively. Initially, if only tap TN and its associated attenuator 63 is considered, it will be observed that an attenuator setting corresponding to a gain of −6 db is required to achieve the desired decay to −60 db in two seconds. On the other hand, if only tap T2 and its associated attenuator 62 or only tap T1 and its associated attenuator 61 are considered, attenuator settings corresponding to gains of −3 db and −1.5 db respectively would be required to achieve a two second decay to the −60 db level. These latter settings, i.e. corresponding to gains of −3 db and −1.5 db, would introduce excessive gain into feedback path 16 rendering its operation highly unstable. Moreover, if attenuators 61 and/or 62 were set equivalent to the setting of attenuator 63, i.e. to achieve a gain of −6 db, the associated decays to the −60 db level would be achieved in only 1.0 and 0.5 seconds respectively instead of the desired 2.0 seconds. Thus, in the present invention, in order to provide a minimum loop gain while achieving a two second decay of −60 db, the attenuators 61, 62 and 63 are set for emphasizing the signals appearing at tap TN relative to the signals appearing at taps T1 and T2. This is accomplished by setting attenuator 63 to the level resulting in a decay to −60 db in two seconds while setting attenuators 61 and 62 to levels of substantially higher attenuation, in relative terms, than the former setting. Significantly, while low in relative terms, absolute value of the attenuation characterizing the attenuator 63 may be set for introducing substantially less loop gain into feedback path 16 than introduced by prior art systems.

With further reference to the previously given example, it will therefore be appreciated that attenuator 63 will be set to a relatively low level resulting in a gain of −6 db. To maintain an overall loop gain of less than about −3 db, attenuators 61 and 62 should be set to relatively high levels introducing a combined gain of no more than about −14 db. In this manner, the total loop gain, 06 db plus −14 db=−3 db, is minimized while a decay to the −60 db level in two seconds is realized.

The setting of attenuators 61, 62 and 63 also have an effect on the frequency characteristics of the signal cycled through delay line 14. In particular, the action of combining a signal with a delay replica thereof produces a resultant signal characterized by an effect known as ripple. The ripple distortion is, in effect, represented by a transfer function comprising a series of adjacent peaks separated by a distance equivalent to the reciprocal of the associated delay time. As such, the ripple effect is less objectionable in situations wherein the time delay associated with the replica signal is relatively long. Attenuators 61, 62 and 63 are set to take the foregoing into account by presenting reduced levels of gain to signals appearing at the taps of delay line 14 having shorter delay times such that the more objectionable ripple components are attenuated to an increased extent. As previously discussed, it has already been shown that attenuator 63 should be set to a low level relative to attenuators 61 and 62 in order to achieve a selected value of loop gain. Also, it was shown that attenuators 61 and 62 should be set to relatively high levels of attenuation corresponding to levels of gain significantly less than the selected gain. Now, in addition, the effect of ripple can be minimized by requiring that the gain introduced by attenuator 61 be less than the gain introduced by attenuator 62. This results in an overall scheme where attenuator 63 is set to a relatively low level (corresponding to a selected gain), attenuator 61 is set to a relatively high level (corresponding to a gain lower than the selected gain) and attenuator 62 is set to a level in between attenuator 61 and 63 (corresponding to a gain in between the selected level and the lower-level). This scheme results in a highly stable feedback path and, at the same time, minimizes the effect of ripple on signals propagated through the path.

Referring to FIG. 4B, the effect of passing echoes 102, 104 and 106 through attenuators 61, 62 and 63 is seen to be that of highly reducing the amplitude of echo 102, reducing the amplitude of echo 104 to a somewhat lesser degree and, finally, only slightly reducing the amplitude of echo 106. As the echoes are cycled and recycled through delay line 14 and feedback path 16, they will gradually decay while nevertheless maintaining the offset amplitude relationships illustrated in FIG. 4B. Output system 18 compensates for this offset to smooth out the reverberation signal developed in feedback path 16 by inserting appropriate amounts of attenuation into lines 81, 82 and 83. More specifically, attenuator 91 is set for introducing a relatively low level of attenuation into line 81 compensating for the high attenuation level that echoes derived from tap T1 were subjected to by attenuator 61; attenuator 92 is set for introducing a medium level of attenuation into line 82 compensating for the medium attenuation level that echoes derived from tap T2 were subjected to by attenuator 62; and finally attenuator 93 is set for introducing a high level of attenuation into line 83 compensating for the low attenuation level to which echoes derived from tap TN were subjected by attenuator 53. The overall effect is to develop a smoothly decaying reverberation signal at the output of summer 90.

Phase selectors 51, 52 and 53 are provided to enable selection of either polarity of signal developed at the respective taps T1–TN. In certain cases, the effects of ripple may be minimized by feeding back either the noninverted or inverted form of the signals developed at the delay line taps. This provides a degree of control over the phase relationships between the feedback signals and the input signal combined in summer 12.

Figure 5:
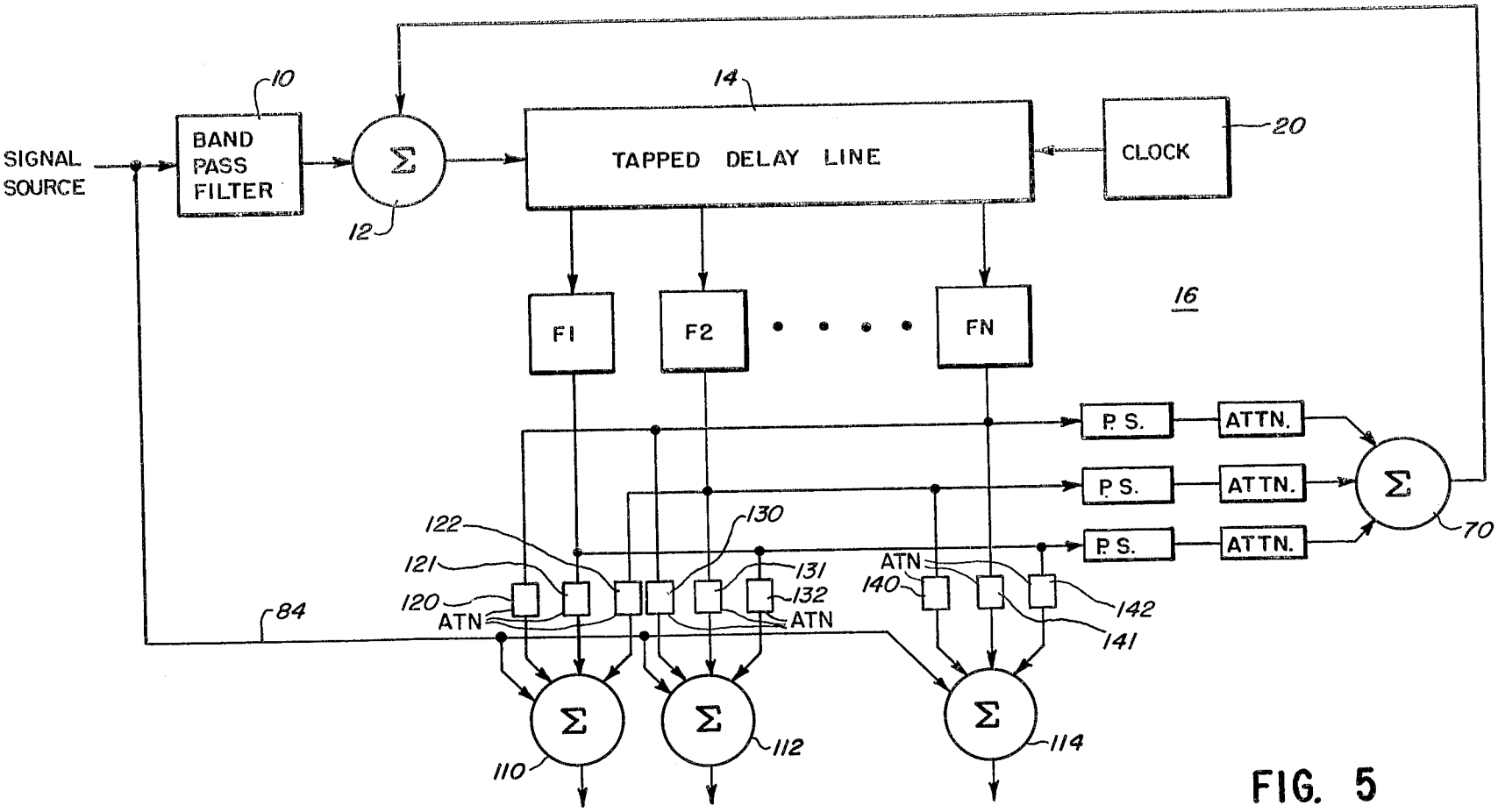
FIg. 5 is a functional block diagram illustrating another embodiment of the reverberation sound producing apparatus of the invention.

FIG. 5 illustrates a variation of the circuit of FIG. 1 providing for the production of multiphonic reverberation from a monophonic source. The circuit is largely similar to that of FIG. 1 except for the output path. In FIG. 5, a series of output summers 110, 112 and 114 are provided each producing an output signal for application to a separate amplification and speaker system. The inputs to each of the summers is derived from all of the filters F1–FN although weighted differently. Thus, summer 110 receives inputs from filters F1–FN through a plurality of attenuators 120, 121 and 122; summer 112 receives input from the filters through attenuators 130, 131 and 132, and summer 114 receives inputs from the filters through attenuators 140, 141 and 142. In addition, each of the summers 110, 112 and 114 receives an input consisting of the original input audio signal developed on line 84.

It will be observed that each individual summer 110, 112 or 114 together with its associated attenuator network forms with the remaining circuitry a reverberation system substantially identical in configuration to that of FIG. 1. However, by differently weighting the input attenuators of summers 110, 112 and 114, the output from each will change with time as the input signal propagates through delay line 14. For example, the attenuators may be weighted such that the echoes sequentially appearing at taps T1–Tn are likewise sounded sequentially by the speaker systems associated with summers 110–112 respectively. In this case, attenuators 121, 131 and 141 would be set for exhibiting a relatively low attenuation while the remaining attenuators would be characterized by a relatively high level of attenuation. It will be appreciated that various other combinations of attenuator settings could be utilized to achieve diverse other effects. Regardless of the selected attenuator combination, the speaker systems driven by summers 110–114 may be placed at different locations around a room whereby the resulting sound will be multiphonic and appear to come from different directions similar to the effect produced by reflections of sound in a large room produced in natural reverberation.

What has been shown is an improved reverberation sound producing apparatus uniquely employing separate feedback and output paths to achieve various beneficial results. In particular, the feedback path design provides for minimum loop gain in association with a given reverberation time, high echo density, and a reduced ripple effect in the frequency response of the delay line. The output path primarily enables the development of a smoothly decaying reverberation signal.

While particular embodiments of the present invention have been shown and described, it will be apparent that changes and modifications may be made therein without departing from the invention in its broader aspects. The aim of the appended claims, therefore, is to cover all such changes and modifications as fall within the true spirit and scope of the invention.

What is claimed is:

1. A reverberation sound producing apparatus comprising:
   - an input terminal and at least one output terminal;
   - a delay line having an input coupled to said input terminal and a plurality of output taps;
   - a feedback path coupling selected irregularly spaced taps of said delay line to said delay line input; and
   - an output path coupling said selected taps to said output terminal.

2. A reverberation sound producing apparatus according to claim 1 including input summing means coupling said input terminal and said feedback path to said delay line input.

3. A reverberation sound producing apparatus according to claim 1 including means for maintaining the loop gain of said feedback path at a relatively low level.

4. A reverberation sound producing apparatus according to claim 1 wherein said feedback path includes means for attenuating signals developed at each of said selected taps as a function of the time delay associated therewith for maintaining the loop gain of said feedback path at a relatively low level and minimizing ripple in the frequency response thereof.

5. A reverberation sound producing apparatus according to claim 4 wherein said attenuating means comprises means for attenuating signals developed at taps associated with short time delays to a greater extent than signals developed at taps associated with longer time delays.

6. A reverberation sound producing apparatus according to claim 1 wherein said feedback and output paths include means for filtering signals developed at each of said selected taps as a function of the time delay associated therewith.

7. A reverberation sound producing apparatus according to claim 6 wherein said filtering means comprises means for low-pass filtering signals developed at each of said selected taps such that signals developed at taps having shorter associated time delays couple increased high frequency content to said feedback path relative to signals developed at taps having longer associated time delays.

8. A reverberation sound producing apparatus according to claim 5 wherein said output path includes means for attenuating signals developed at each of said selected taps as a function of the time delay associated therewith.

9. A reverberation sound producing apparatus according to claim 8 wherein said output path attenuating means comprises means for attenuating signals developed at taps associated with longer time delays to a greater extent than signals developed at taps associated with shorter time delays.

10. A reverberation sound producing apparatus according to claim 1 wherein said feedback path includes means for selectively inverting the polarity of signals developed at each of said selected taps.

11. A reverberation sound producing apparatus according to claim 1 including a plurality of output terminals and circuit means coupling each of said output terminals to each of said selected taps.

12. A reverberation sound producing apparatus according to claim 11 wherein said circuit means comprises a plurality of attenuators independently coupling each of said selected taps to each of said output terminals.

13. Apparatus for producing a reverberation signal for application to an output speaker system comprising:
- a source of input signals;
- a delay line having an input and a plurality of output taps;
- means for coupling said input signal to said delay line input;
- a feedback path comprising a plurality of networks each connected between a different selected one of said output taps and said delay line input; and
- an output path comprising a plurality of networks each connected between a respective one of said selected output taps and said output speaker system.

14. The apparatus according to claim 13 wherein each of said feedback path networks includes an attenuator, said feedback path attenuators being set for causing said feedback path to exhibit a relatively low loop gain and a frequency response characterized by a minimal ripple effect.

15. The apparatus according to claim 14 wherein said feedback path attenuators decrease in value as the delay time of the associated output tap increases in value.

16. The apparatus according to claim 13 wherein each of said selected taps includes a low-pass filter characterized by a unique cut-off frequency, said cut-off frequencies decreasing in value as the delay time of the associated output tap increases in value.

17. The apparatus according to claim 15 wherein each of said output path networks includes an attenuator, said output path attenuators being set for producing a smoothly decaying reverberation signal.

18. The apparatus according to claim 17 wherein said output path attenuators increase in value as the delay time of the associated output tap increases in value.

19. Apparatus for producing a multiphonic reverberation signal from a monophonic source for application to a plurality of output speaker systems comprising:
- a delay line having an input and a plurality of output taps;
- means coupling said monophonic source to said delay line input;
- a feedback path comprising a plurality of networks each connected between a different selected one of said output taps and said delay line input; and
- an output path comprising a plurality of networks for independently connecting each of said selected taps to each of said plurality of output speaker systems.

20. Apparatus according to claim 19 wherein each of said feedback path networks includes an attenuator having a setting decreasing in value as the delay time of the associated output tap increases in value for causing said feedback path to exhibit a relatively low loop gain, and a frequency response characterized by a minimal ripple effect.

21. Apparatus according to claim 20 wherein each of said selected taps includes a low-pass filter characterized by a unique cut-off frequency, said cut-off frequencies decreasing in value as the delay time of the associated output tap increases in value.

22. Apparatus according to claim 19 wherein each of said output path networks includes an attenuator, said output path attenuators being set for producing a desired multiphonic effect from said source.

23. A reverberation sound producing apparatus comprising:
- an input terminal and at least one output terminal;
- a delay line having an input coupled to said input terminal and a plurality of output taps;
- means for filtering the signals developed at selected taps of said delay line as a function of the time delay associated therewith;
- a feedback path coupling said filtered signals to said delay line input; and
- an output path coupling said filtered signals to said output terminal.

24. Apparatus for producing a reverberation signal for application to an output speaker system comprising:
- a source of input signals;
- a delay line having an input and a plurality of output taps;
- means for coupling said input signal to said delay line input;
- a plurality of low-pass filter means each connected to a respective selected tap of said delay line, said plurality of low-pass filter means each being characterized by a cut-off frequency, said cut-off frequencies decreasing in value as the delay time of the associated output tap increases in value;
- a feedback path comprising a plurality of networks each connected between one of said filter means and said delay line input; and
- an output path comprising a plurality of networks each connected between one of said filter means and said output speaker system.

25. Apparatus for producing a multiphonic reverberation signal from a monophonic source for application to a plurality of output speaker systems comprising:
- a delay line having an input and a plurality of output taps;
- means coupling said monophonic source to said delay line input;
- means for filtering the signals developed at selected taps of said delay line as a function of the time delay associated therewith;
- a feedback path comprising a plurality of networks for coupling each of said filtered signals to said delay line input;
- an output path comprising a plurality of networks for coupling each of said filtered signals to each of said plurality of output speaker systems.

* * * * *